US006250322B1

(12) United States Patent
Porter

(10) Patent No.: US 6,250,322 B1
(45) Date of Patent: Jun. 26, 2001

(54) UMBRELLA-SHAPED SHELTER

(76) Inventor: William H. Porter, P.O. Box 249, Saugatuck, MI (US) 49453

( * ) Notice: Subject to any disclaimer, the term of this patent is extended or adjusted under 35 U.S.C. 154(b) by 0 days.

(21) Appl. No.: 09/250,659

(22) Filed: Feb. 16, 1999

(51) Int. Cl.[7] ..... A45B 25/00; E04H 15/26; E04H 15/28

(52) U.S. Cl. ..... 135/98; 135/99; 135/15.1; 135/907

(58) Field of Search ..... 135/98, 99, 15.1, 135/33.41, 907

(56) References Cited

U.S. PATENT DOCUMENTS

| | | | | |
|---|---|---|---|---|
| 244,058 | | 7/1881 | Hoek et al. . | |
| 519,178 | * | 5/1894 | Douglas et al. . | |
| 657,593 | * | 9/1900 | Dix . | |
| 1,543,134 | * | 6/1925 | Tood . | |
| 2,466,595 | | 4/1949 | Korman . | |
| 2,485,118 | | 10/1949 | Simpson . | |
| 2,577,317 | | 12/1951 | Eschrich . | |
| 4,023,582 | | 5/1977 | Buzzella et al. . | |
| 4,184,502 | * | 1/1980 | Anderson | 135/34 |
| 4,545,629 | * | 10/1985 | Hackett . | |
| 4,677,796 | | 7/1987 | Mellott . | |
| 4,890,634 | * | 1/1990 | Dalo et al. | 135/99 |
| 4,951,327 | * | 8/1990 | Del Gorio | 135/144 X |
| 5,259,077 | * | 11/1993 | Hager et al. . | |
| 5,444,943 | * | 8/1995 | Schelfhorst | 52/63 |
| 5,806,547 | * | 9/1998 | Derlings | 135/98 X |

* cited by examiner

*Primary Examiner*—Robert Canfield
(74) *Attorney, Agent, or Firm*—Emrich & Dithmar

(57) ABSTRACT

An umbrella-shaped shelter includes a single vertical support member either permanently mounted to a support surface, such as the ground, or removably attached to a mounting base disposed on or in the support surface. The lower end of the vertical support member may be mounted in a concrete base, removably inserted in a tubular sleeve disposed in the support surface, or may be attached to the support surface using anchor bolts, or ground anchors. In one embodiment, the lower end of the vertical support member is attached to a base including outwardly extending, radially disposed base members which, in turn, are mounted to the support surface such as by ground anchors. Concentrically disposed about and attached to an upper end of the vertical support member by radially extending frame members is a circular ring. A fabric cover is disposed over a cap on the upper end of the vertical support member and about the circular ring. Disposed on the peripheral edge of the generally circular fabric cover is a hem which is adapted to receive a cable, or rope, extending about the periphery of the fabric cover. The cable or rope is pulled tight and secured with the fabric cover disposed over the upper end of the vertical support member and its peripheral edge disposed about the circular ring to securely attach the fabric cover under tension to the vertical support member and circular ring, with tension on the cover adjustable as desired.

18 Claims, 5 Drawing Sheets

UMBRELLA-SHAPED SHELTER

FIELD OF THE INVENTION

This invention relates generally to free-standing shelters and is particularly directed to an umbrella-shaped shelter having a single vertical support member and a fabric cover attached to and radially disposed about an upper end of the vertical support member.

BACKGROUND OF THE INVENTION

Shelters are used in various environments, such as on golf courses, beaches, recreational parks, and in the work environment. In most cases, it is highly desirable that the shelter afford a high degree of structural strength to accommodate various environmental stresses, such as high wind loads, or snow loads. In addition, the shelter components should be easily and inexpensively fabricated, and capable of easy assembly. The shelter should be comprised of durable materials and afford an overall shape and appearance which is aesthetically pleasing.

In an effort to simplify the design, reduce the cost of assembly, and still provide a structurally strong, attractive structure, some shelters are constructed with a single vertical support post, or column. The roof may take on various forms such as that of a round, cone-shaped cover, or a hip roof. Examples of shelters having a single vertical support with a cone-shaped roof, and thus having the general shape of an umbrella, can be found in U.S. Pat. Nos. 244,058 to Hoek; 2,466,585 to Korman; 2,485,118 to Simpson; 2,577,317 to Eschrich; 4,023,582 to Buzzella et al.; and 4,677,796 to Mellott. All of the shelters disclosed in the aforementioned patents include a cone-shaped roof comprised of rigid material, such as wood, metal, or plastic. The roofs generally are comprised of a plurality of flat members extending radially from the central support column, and having the form of a sector, where adjacent sectors are connected together and arranged in an overlapping manner. Umbrellas having a cloth or fabric cover generally offer more flexibility in structural design as well as in the design and color of the shelter's cover. However, shelters having a fabric cover and in the general form of an umbrella typically have only limited structural strength and must be taken down in windy conditions to avoid tearing and destruction of the cover.

The present invention addresses the aforementioned limitations of the prior art by providing an umbrella-shaped shelter having a single vertical support column and a fabric cover, or roof, which is securely attached to an upper portion of the shelter's structural frame in a manner which allows tension on the fabric cover to be adjusted for optimum fabric wear.

OBJECTS AND SUMMARY OF THE INVENTION

Accordingly, it is an object of the present invention to provide a circular shelter having a single vertical support upright and a fabric cover which is free-standing, easily assembled and of high structural strength.

Another object of the present invention is to provide a permanently mounted, or removably installed, umbrella-shaped shelter comprised of a structural steel frame and a fabric cover and including an arrangement for adjusting the tension of the fabric cover.

Yet another object of the present invention is to provide an umbrella-shaped shelter having a fabric cover which is maintained under tension to withstand high wind loads and which is easily removed and re-installed.

A further object of the present invention is to provide an umbrella-shaped shelter having a fabric cover and a support frame with components adapted for sliding engagement during assembly and forming connections that are maintained by coupling bolts.

This invention contemplates a shelter comprising a vertical support column having an upper end and a lower end disposed on a support surface; a support frame attached to the support column adjacent its upper end, the support frame including a generally circular ring member concentrically disposed about the vertical support column; a flexible fabric cover disposed over and engaging the upper end of the support column and the ring member; and a retaining arrangement for maintaining the fabric roof disposed about and engaging the ring member in a stretched condition under tension.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
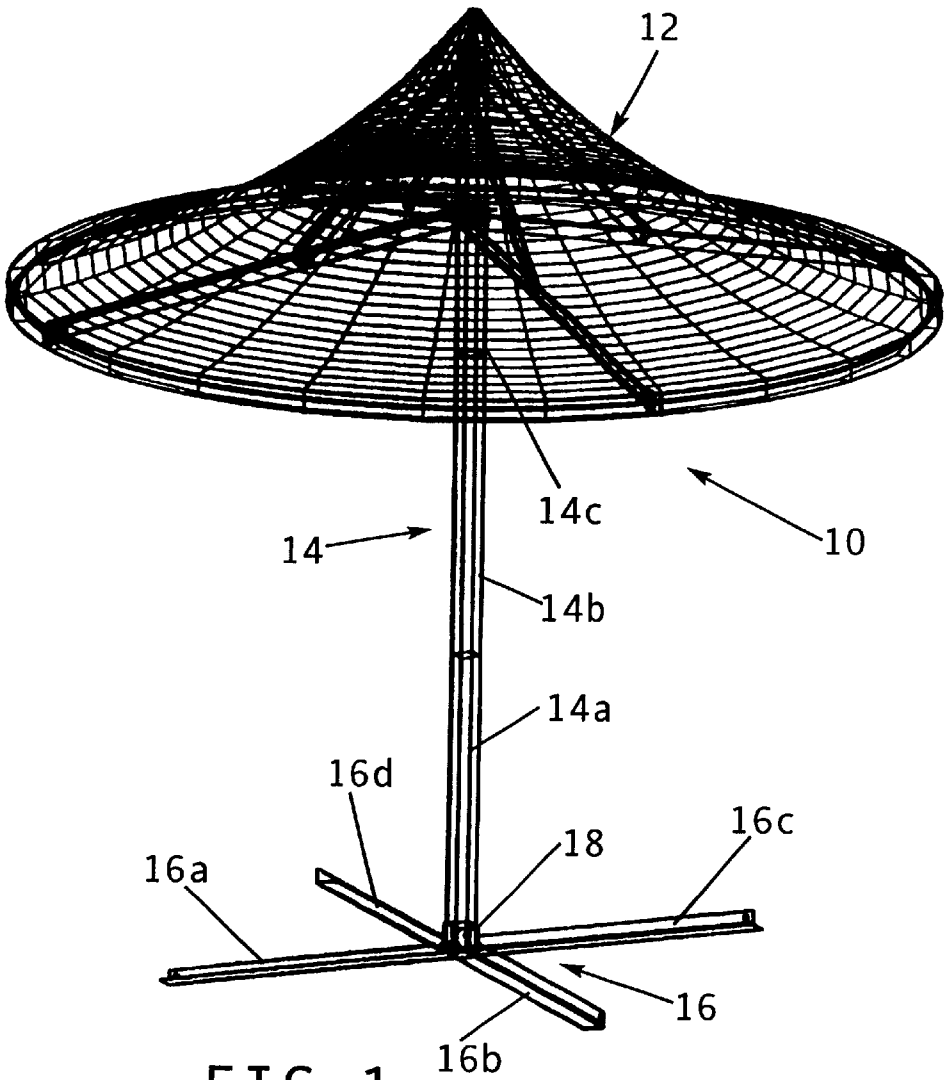
FIG. 1 is a perspective view of an umbrella-shaped shelter in accordance with the present invention.
Figure 2:
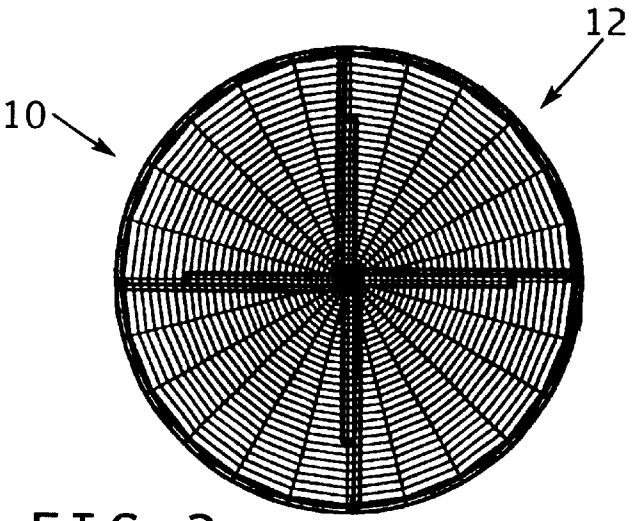
FIG. 2 is a top plan view of the umbrella-shaped shelter shown in FIG. 1.
Figure 3:
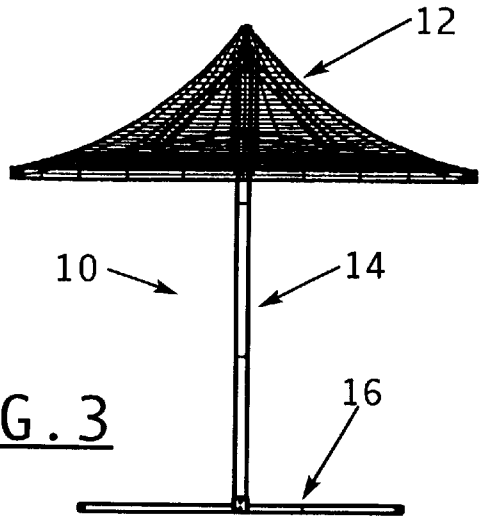
FIG. 3 is a side elevation view of the inventive umbrella-shaped shelter shown in FIG. 1.
Figure 5:
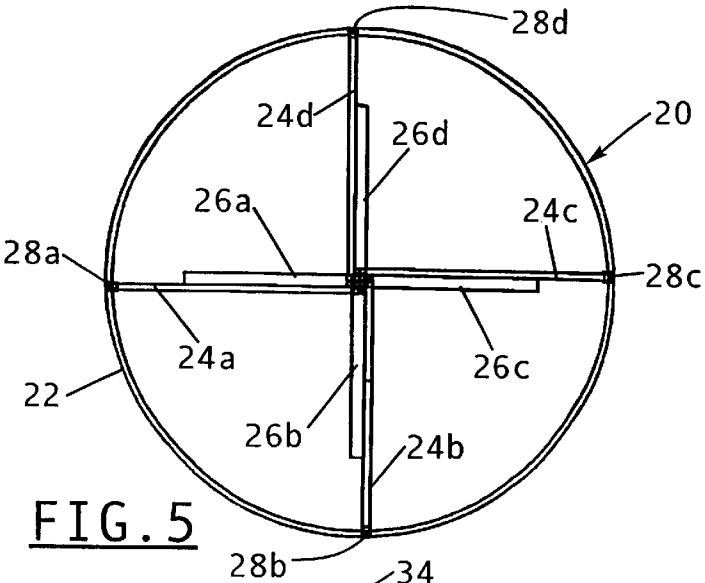
FIG. 5 is a top plan view of the shelter support frame shown in FIG. 4.
Figure 6:
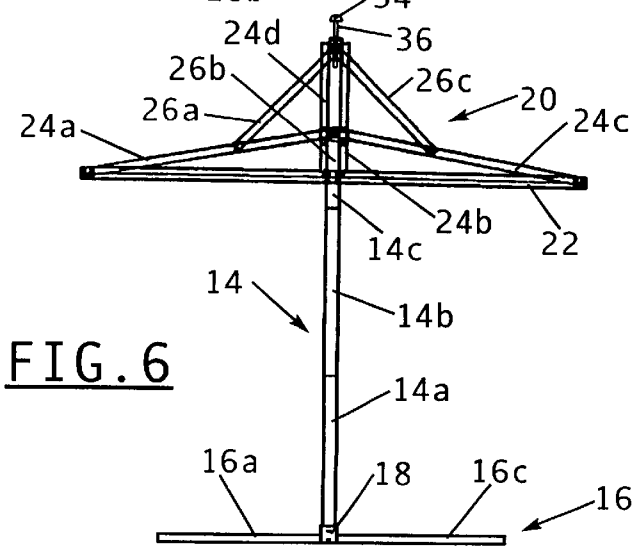
FIG. 6 is a side elevation view of the shelter support frame shown in FIG. 4.

Referring to FIG. 1, there is shown a perspective view of an umbrella-shaped shelter 10 in accordance with the principles of the present invention. FIGS. 2 and 3 are respectively top plan and side elevation views of the inventive umbrella-shaped shelter 10 shown in FIG. 1. The present invention will also now be described in terms of FIGS. 4, 5 and 6, which are respectively perspective, top plan, and side elevation views of the umbrella-shaped shelter's support frame.

Figure 4:
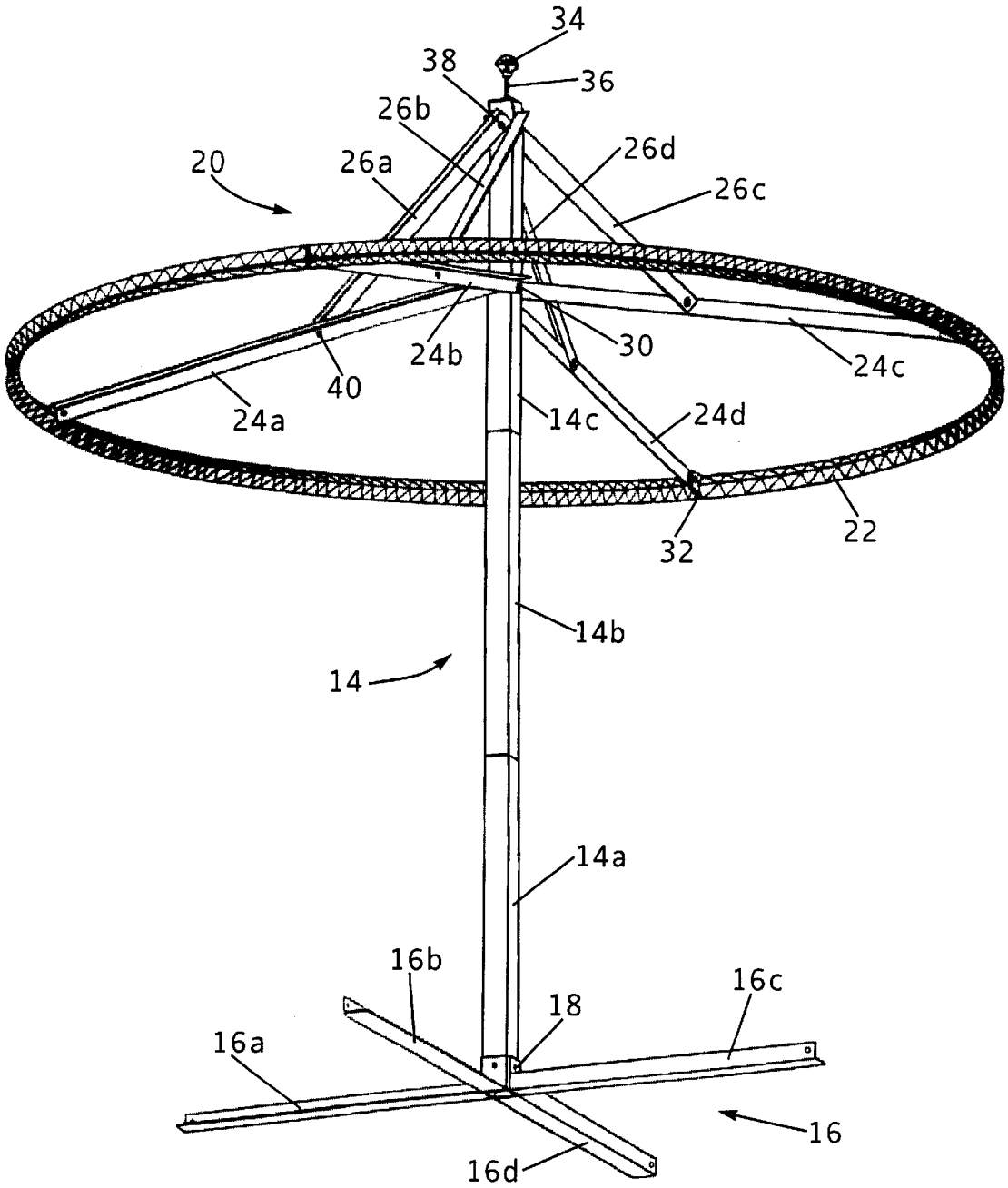
FIG. 4 is a perspective view of the support frame of the umbrella-shaped shelter of the present invention.

The umbrella-shaped shelter 10 includes a vertical support column 14 having a lower end mounted to a support surface and an upper end to which is attached a roof support frame 20. The vertical support column 14 and roof support frame 20 are preferably comprised of a lightweight, high strength structural material such as metal (steel, aluminum, etc.), plastic or fiberglass. Attached to and supported by the roof support frame 20 is a fabric cover 12. Roof support frame 20 is generally circular and includes a roof ring 22 attached to an upper portion of the vertical support column 14 by means of various structural members extending radially outward from the vertical support column. These structural members include first, second, third and fourth lower radial structural members 24*a*–24*d*. Each of the lower radial structural members 24*a*–24*d* has a respective inner end connected to an upper portion of the vertical support column 14 by means of connecting bolt 30 as shown in the perspective view of FIG. 4. The outer end of each of the lower radial structural members 24*a*–24*d* is securely connected to the roof ring 22 by means of a combination of a connecting bolt and a connecting bracket 32 also as shown in FIG. 4. The radially extending structural members further include first, second, third and fourth upper radial structural members 26*a*–26*d*, each of which is connected by means of a respective bolt 38 to an upper end of the vertical support column 14. The outer end of each of the upper radial structural members 26*a*–26*d* is coupled to a respective intermediate portion of a lower support member by means of a respective connecting bolt 40. Thus, distal ends of the first, second, third and fourth upper radial structural members 26*a*–26*d* are coupled to respective intermediate portions of lower structural members 24*a*–24*d*. In one embodiment, the vertical support column 14 includes lower, middle and upper support members 14*a*, 14*b* and 14*c*, with the aforementioned lower and upper radial structural members connected to the upper support member 14*c* of the vertical support column 14. The combination of a cap 34 and a tension screw 36 is attached to an upper end of the shelter's vertical support column 14 as described in detail below.

Attached to a lower end of the vertical support column 14 is a base 16 comprised of first, second, third and fourth radial base members 16*a*–16*d*. Each of the four radial base members 16*a*–16*d* is securely coupled to a lower end of the vertical support column 14 by means of a combination of mounting bolts and a coupling bracket 18 disposed on a lower end of the vertical support column. In one embodiment of the present invention, each of the lower, middle and upper support members 14*a*, 14*b* and 14*c* of the vertical support column 14 is adapted to fit into an end of an adjacent support member to which it is connected in a sliding, telescopic manner. A bolt (not shown for simplicity) inserted through adjacent, coupled ends of a pair of vertical column support members may be used to more securely attach the connected support members. The structural members thus far described including the roof ring 22 are preferably comprised of a lightweight, high-strength material such as plastic, metal or fiberglass.

Figure 7:
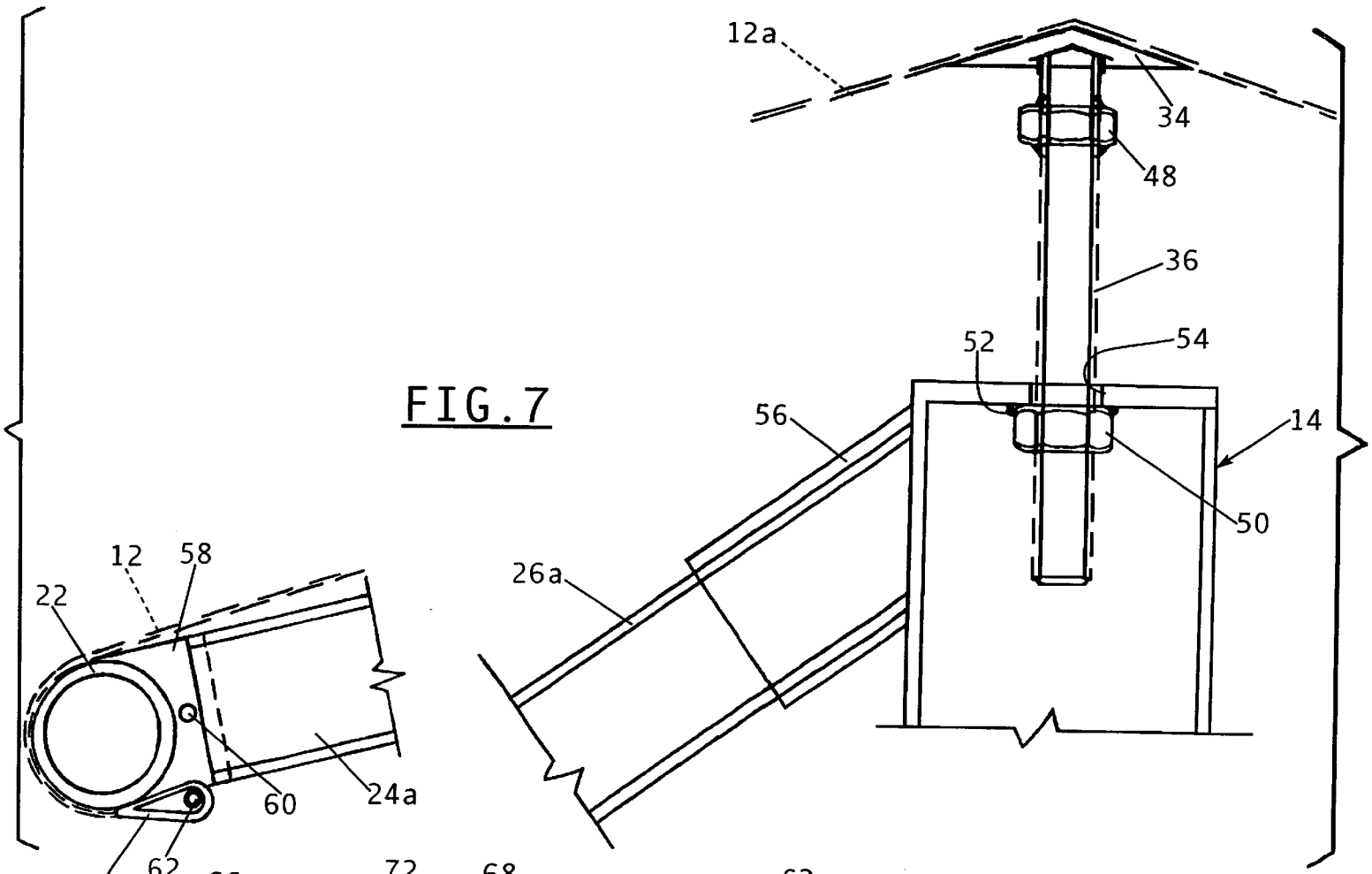
FIG. 7 is an exploded partial sectional view showing a portion of the upper support frame and the fabric cover of the umbrella-shaped shelter of the present invention.

Referring to FIG. 7, there is shown a partial sectional view of the upper frame of the umbrella-shaped shelter illustrating the manner in which the shelter's fabric cover 12 (shown in dotted line form in the figure) is secured in position. As previously described, a tension screw 36 is attached to an upper end of the shelter's vertical support column 14. Tension screw 36 is inserted through an aperture 54 in the upper end of the shelter's vertical support column 14. Attached to an upper, inner portion of the vertical support column 14 by means of a weldment 52 is a mounting nut 50. Mounting nut 50 is disposed about the aperture 54 in the upper end of the vertical support column 14 and is also adapted to receive the tension screw 36 in threaded engagement. A fixed nut 48 is attached to the tension screw 36 and facilitates rotation of the tension screw. Rotation of the combination of fixed nut 48 and tension screw 36 in a first direction extends the tension screw outwardly from the shelter's vertical support column 14, while rotation of the combination of the fixed nut and tension screw in a second, opposed direction causes the tension screw to be withdrawn into the shelter's vertical support column. Disposed on the distal end of the tension screw 36 is the aforementioned cap 34 which is displaced either away from or toward the upper end of the vertical support column 14 as the tension screw 36 is either extended from or withdrawn into the vertical support column. Cap 34 is provided with a smooth, curvilinear upper surface for engaging a center, lower portion of the shelter's fabric cover 12. For the sake of clarity, the center portion of the fabric cover 12 is identified as element 12*a* in the right-hand portion of FIG. 7.

As previously described, the outer end of each of the lower radial structural members is connected to the shelter's roof ring 22 by means of a connecting bracket as shown for the case of the first lower radial structural member 24*a* which is connected to the roof ring by means of the combination of connecting bracket 58 and mounting bolt 60. The inner end of lower radial structural member 24*a* is connected to the shelter's vertical support column 14 by means of a connecting bolt as previously described, which is not shown in FIG. 7 for simplicity. Each of the upper radial structural members is connected to an upper end of the shelter's vertical support column 14 by means of a mounting sleeve, as shown for the case of the first upper radial structural member 26*a* inserted in mounting sleeve 56 in FIG. 7. Each of the mounting sleeves is attached to an upper end of the shelter's vertical support column 14 by conventional means such as a weldment. The outer end of each of the upper radial support members is connected to an intermediate portion of an associated lower radial structural member by means of a coupling bolt as described above, although this is not shown in FIG. 7 for simplicity.

The fabric cover 12, which is generally circular, is provided with a hem 64 about its periphery. A cable, or rope, 62 is inserted in the fabric cover's hem 64 and extends around its outer periphery. In securing the fabric cover 12 to an upper portion of the umbrella-shaped shelter, the fabric cover is first disposed over the cap 34 on the upper end of the shelter's vertical support column 14 and is further disposed about the shelter's roof ring 22. Cable 62 is then pulled tight causing the fabric cover 12 to be stretched over the upper frame of the shelter. With cable 62 pulled tight about the fabric cover 12, the fabric cover is maintained under tension in a stretched condition on the upper frame of the shelter. The tension in the fabric cover 12 may be increased by upward displacement of the cap 34 by rotating the nut 48 and tension screw 36 combination in a first direction. Similarly, tension in the fabric cover 12 may be reduced by lowering the cap 34 by rotation of the combination of nut 48 and tension screw 36 in a second, opposed direction. In this manner, the tension in the fabric cover 12 may be adjusted as desired for maintaining the fabric cover in a taut, stretched condition to reduce the likelihood of tearing or other damage to the fabric cover in high wind loading conditions. In addition, tension on the fabric cover may be increased as the roof material becomes stretched with use over time for increasing the useful lifetime of the fabric cover. The capability to selectively adjust the tension of the fabric cover 12 also permits various materials to be used for the roof. The fabric cover 12 may be comprised of virtually any type of fabric including a loose knit mesh to serve as a sun block or a vinyl-coated fabric which would provide shade as well as protection from rain. A loose knit mesh fabric could be stretched over the shelter's upper frame, while most water-proof fabrics would be non-stretchable.

Figure 8:
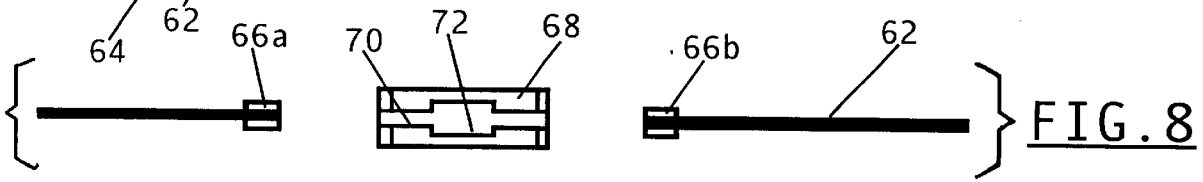
FIG. 8 is an exploded view of a coupler for attaching the fabric cover to the upper support frame of the umbrella-shaped shelter of the present invention.

Referring to FIG. 8, there is shown an arrangement for securing the opposed ends of cable 62 together. Cable 62 is preferably comprised of steel strands, but may also be formed of other conventional materials such as high strength plastic strands or rope. Attached to respective opposed ends of cable 62 are first and second clasps 66*a* and 66*b*. The first and second clasps 66*a*, 66*b* are adapted for insertion in an enlarged aperture 72 in a cable connector 68. With the first and second clasps 66*a*, 66*b* inserted in the enlarged aperture 72 of the cable connector 68, the ends of the cable 62 are positioned within an elongated slot 70 in the cable connector. With the cable 62 under tension, its end clasps 66*a*, 66*b* are maintained in the cable connector 68 when the cable is pulled tight about the periphery of the fabric cover 12 which is disposed about the shelter's roof ring 12. In this manner, cable 62 is maintained in a stretched condition within the hem 64 of the fabric cover 12 and the cover is maintained in a stretched condition on the upper support structure of the umbrella-shaped shelter of the present invention. The first and second cable end clasps 66*a*, 66*b* may be comprised of a conventional material such as steel, or a high strength plastic, and may be secured to respective ends of the cable 62 by conventional means such as crimping. Various other arrangements well known to those skilled in the relevant arts may also be used to securely connect together the ends of cable 62.

Figure 9:
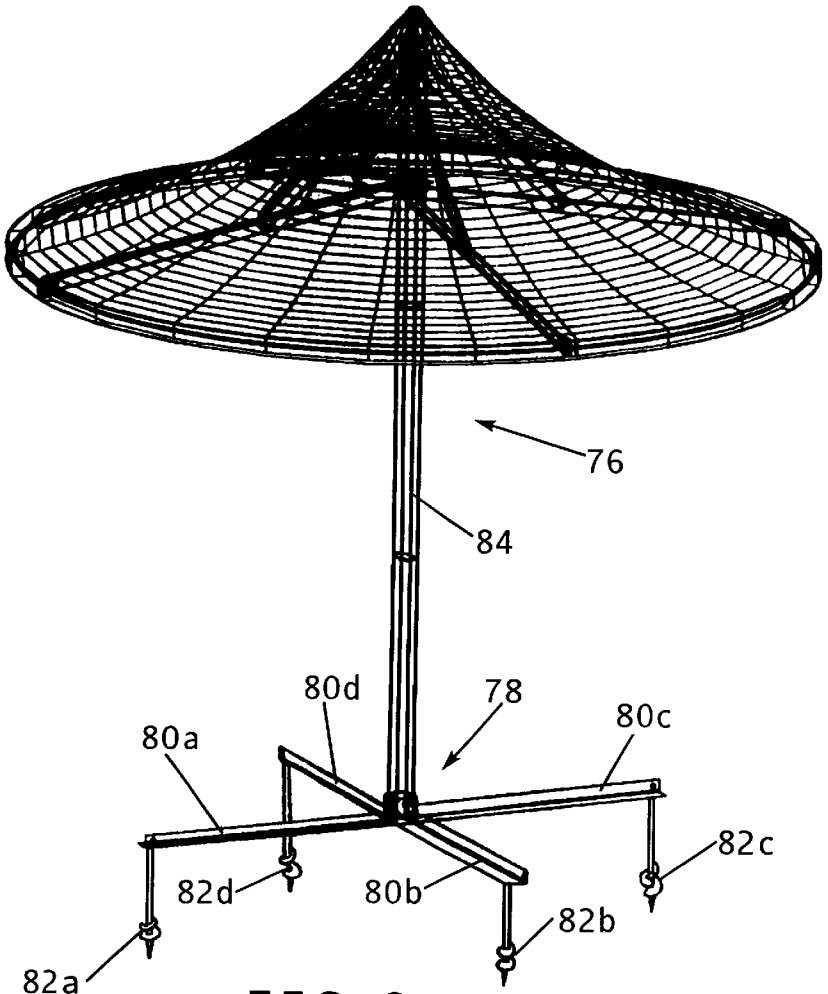
FIG. 9 is a perspective view of an umbrella-shaped shelter in accordance with the present invention showing one approach for mounting the shelter to the ground.

Referring to FIG. 9, there is shown one embodiment of an arrangement for securing an umbrella-shaped shelter 76 in accordance with the present invention to a support surface such as the ground. A side elevation view of the umbrella-shaped shelter 76 and mounting arrangement therefore as shown in FIG. 9 is illustrated in FIG. 10*d*. Umbrella-shaped shelter 76 includes a base 78 having first, second, third and fourth radial base members 80*a*–80*d* coupled to and extending outwardly from the lower end of the shelter's vertical support column 84. Attached respectively to the distal ends of each of the first through fourth radial base members 80*a*–80*d* are first through fourth earth anchors 82*a*–82*d*. Each of the earth anchors 82*a*–82*d* includes a respective auger element for insertion into and secure engagement with the ground 85 as shown in FIG. 10*d*.

Figure 10A:
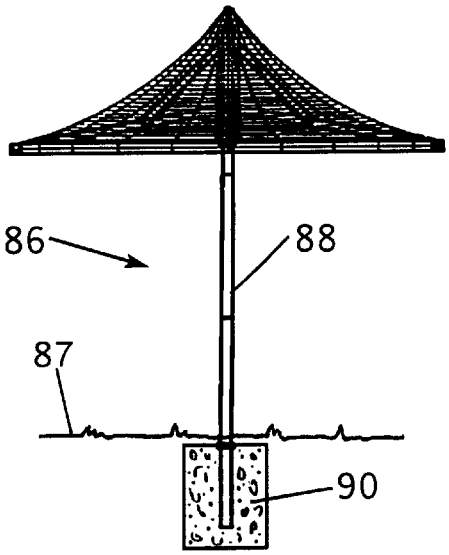
FIGS. 10*a*–10*d* are side elevation views of an umbrella-shaped shelter in accordance with the present invention illustrating various arrangements for mounting the shelter to a support surface, such as the ground.
Figure 10B:
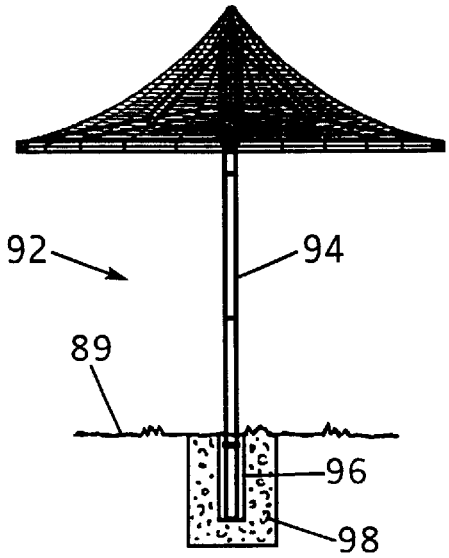
Figure 10C:
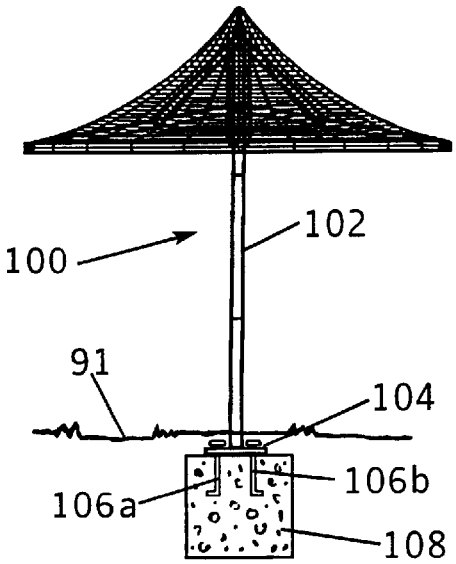
Figure 10D:
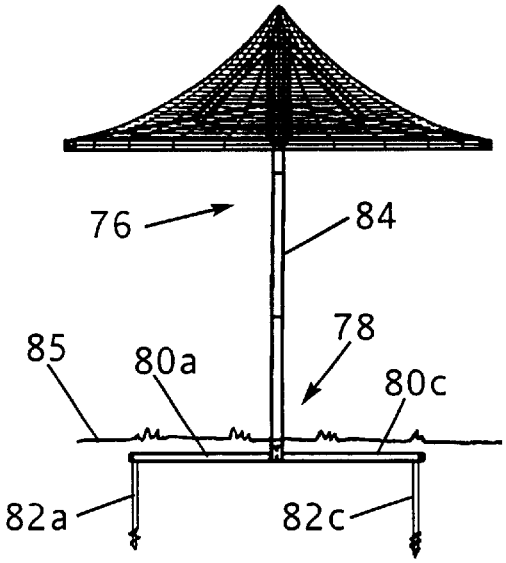

Referring to FIGS. 10*a*, 10*b* and 10*c*, there are shown side elevation views of other arrangements for securely mounting an umbrella-shaped shelter in accordance with the present invention to a support surface such as the ground. In FIG. 10*a*, the umbrella-shaped shelter 86 is shown with a vertical support column 88, the lower end of which is inserted in a concrete base 90 disposed in the ground 87. In the arrangement of FIG. 10*b*, the vertical support column 94 of an umbrella-shaped shelter 92 is inserted in a tubular sleeve 96 disposed in a concrete base 98. The concrete base is disposed in the ground 89 in a manner which allows access to its tubular sleeve 96 to allow for insertion of the shelter's vertical support column 94 into the concrete base as well as its removal therefrom. In the arrangement of FIG. 10*c*, the vertical support column 102 of an umbrella-shaped shelter 100 is provided with a generally flat mounting plate 104 attached to the lower end of the column. A pair of anchor bolts 106*a* and 106*b* are inserted through respective apertures in the mounting plate 104 and are positioned within a concrete base 108. The concrete base 108 is buried in the ground 91 and the anchor bolts 106*a*, 106*b* in combination with plate 104 securely attach the shelter's vertical support column 102 to the buried concrete base.

There has thus been shown an umbrella-shaped shelter having a fabric cover attached to an upper support structure mounted to and supported by a vertical support column. The shelter's upper support structure includes a plurality of support members connected to and radially extending from an upper end of the support column. The upper support structure further includes a circular ring concentrically disposed about the vertical support column and attached to outer ends of the radially extending support members. A circular fabric cover is disposed over the upper end of the support column and upper structural member and about the circular ring. The circular periphery of the fabric cover is provided with a hem in which a cable or rope is inserted. The cable is pulled tight so as to stretch the circular fabric cover over the upper end of the support column and about the circular ring. Disposed on the upper end of the vertical support column and engaging the center, lower portion of the fabric cover is a tension screw and cap combination for adjusting the tension in the fabric cover. The lower end of the shelter's vertical support column may be securely mounted to a support surface such as the ground by various means such as ground anchors or a concrete base. The lower end of the vertical support column may be disposed in the concrete base or connected to the concrete base by means of anchor bolts. In another embodiment, a tubular sleeve is disposed in the concrete base and the lower end of the shelter's vertical support column is removably inserted in the tubular sleeve to provide a non-permanent mounting for the umbrella-shaped shelter.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

I claim:

1. A free-standing shelter comprising:

a vertical support column having an upper end and a lower end disposed on a support surface;

a support frame attached to said support column adjacent its upper end, said support frame including a generally circular ring member concentrically disposed about said vertical support column;

a flexible fabric cover disposed over and engaging the upper end of said support column and said ring member;

retaining means for maintaining said fabric cover disposed about and engaging said ring member in a stretched condition under tension; and tension adjustment means engaging said fabric cover for increasing the tension on the cover.

2. The shelter of claim 1 wherein said support column and said support frame are comprised of metal, plastic or fiberglass.

3. The shelter of claim 1 wherein said support column includes a plurality of linear, elongated support members, and wherein adjacent support members are coupled together end-to-end in a sliding, telescoping manner.

4. The shelter of claim 1 wherein said support frame includes a plurality of elongated, linear structural members coupled to and extending outwardly from said support column in a radial manner.

5. The shelter of claim 4 wherein said structural members include lower radial structural members coupling said support column and said ring member and upper radial structural members each coupling said support column to an intermediate portion of one of said lower radial structural members.

6. The shelter of claim 1 wherein said fabric cover is generally circular and includes a peripheral edge portion disposed about said circular ring.

7. The shelter of claim 6 wherein said retaining means includes a high strength, flexible member engaging the peripheral edge portion of said fabric cover and urging the fabric cover's peripheral edge portion inwardly toward said support column.

8. The shelter of claim 7 wherein said high strength, flexible member is a rope or a metal cable.

9. The shelter of claim 7 wherein said fabric cover includes a hem disposed about a peripheral edge thereof, and wherein said high strength, flexible member is disposed within said hem around the edge of said fabric cover.

10. The shelter of claim 1 wherein said tension adjustment means includes a tension screw coupled to the upper end of said support column and a cap disposed on an upper end of said tension screw and engaging a center portion of said fabric cover, wherein said cap and the center portion of said fabric cover are displaced upwardly by rotation of said tension screw in a first direction for increasing tension on said fabric cover.

11. The shelter of claim 10 wherein said cap has an upwardly directed, smooth, curvilinear surface for engaging the fabric roof.

12. The shelter of claim 1 further comprising mounting means for connecting the lower end of said support column to the support surface.

13. The shelter of claim 12 wherein said mounting means includes a concrete base disposed in or on said support surface, and wherein the lower end of said support column is disposed in said concrete base.

14. The shelter of claim 12 wherein said mounting means includes a concrete base disposed in or on said support surface, and wherein the lower end of said support column is coupled to said concrete base by means of anchor bolts.

15. The shelter of claim 13 further comprising a tubular sleeve in said concrete base, wherein the lower end of said support column is inserted in said tubular sleeve in a removable manner.

16. The shelter of claim 1 wherein said support surface is the ground, and said shelter further includes a base attached to the lower end of said support column and disposed in the ground.

17. The shelter of claim 16 further comprising earth anchors coupling said base to the ground.

18. A free-standing shelter having a fabric cover comprising:

a vertical support column having upper and lower ends;

a base attached to the lower end of said support column for mounting the support column on a support surface;

a support frame coupled to and disposed about the upper end of said support column for receiving and supporting the fabric cover;

tension means engaging a peripheral edge of the fabric cover for maintaining the fabric cover tightly stretched on said support frame; and adjustable means coupled to the fabric cover for adjusting the tension in the fabric cover.

* * * * *